US008354605B2

(12) United States Patent
Nogami

(10) Patent No.: US 8,354,605 B2
(45) Date of Patent: Jan. 15, 2013

(54) INPUT DEVICE FOR IN-VEHICLE DEVICE

(75) Inventor: Shin_ichi Nogami, Ibaraki (JP)

(73) Assignee: Clarion Co., Ltd., Tokyo (JP)

( * ) Notice: Subject to any disclaimer, the term of this patent is extended or adjusted under 35 U.S.C. 154(b) by 229 days.

(21) Appl. No.: 12/813,967

(22) Filed: Jun. 11, 2010

(65) Prior Publication Data

US 2010/0314227 A1 Dec. 16, 2010

(30) Foreign Application Priority Data

Jun. 12, 2009 (JP) ..... 2009-141399

(51) Int. Cl.
*H01H 13/06* (2006.01)

(52) U.S. Cl. ..... 200/302.1; 200/302.2; 200/341; 200/345

(58) Field of Classification Search ..... 200/4, 5 R, 200/6 A, 302.1–302.3, 17 R, 18, 1 B, 343–345; 341/22, 35; 345/161, 168, 169, 184
See application file for complete search history.

(56) References Cited

U.S. PATENT DOCUMENTS

| | | | | |
|---|---|---|---|---|
| 3,172,981 | A * | 3/1965 | Loesch | 200/531 |
| 4,308,434 | A | 12/1981 | Roeser | |
| 4,482,791 | A * | 11/1984 | Rendgen | 200/343 |
| 4,877,930 | A * | 10/1989 | Fukuma | 200/302.2 |
| 4,897,516 | A * | 1/1990 | Wakatsuki | 200/302.2 |
| 4,968,862 | A | 11/1990 | Maeda | |
| 5,117,074 | A | 5/1992 | Yanai et al. | |
| 5,412,165 | A * | 5/1995 | Malone et al. | 200/5 R |
| 5,421,659 | A | 6/1995 | Liang | |
| 5,453,589 | A * | 9/1995 | Mayer | 200/302.1 |
| 5,753,874 | A * | 5/1998 | Kossakowski | 200/1 B |
| 5,760,356 | A * | 6/1998 | Garcia et al. | 200/302.2 |
| 6,717,082 | B1 * | 4/2004 | Wu | 200/302.2 |
| 2003/0024795 | A1 * | 2/2003 | Suzuki | 200/6 A |
| 2005/0011736 | A1 * | 1/2005 | Mori et al. | 200/5 R |

FOREIGN PATENT DOCUMENTS

| | | | |
|---|---|---|---|
| EP | 1552985 | A1 | 7/2005 |
| JP | 2002-279851 | A | 9/2002 |
| JP | 2006-331917 | | 12/2006 |
| WO | 01/70507 | A1 | 9/2001 |

OTHER PUBLICATIONS

European Search Report dated Sep. 23, 2010.
European Search Report dated Oct. 13, 2010.

* cited by examiner

*Primary Examiner* — Michael Friedhofer
(74) *Attorney, Agent, or Firm* — Scully, Scott, Murphy & Presser, P.C.

(57) ABSTRACT

A technique of preventing permeation of liquid and dust to electronic parts within a housing of an input device for an in-vehicle device.
An input device of an in-vehicle device comprises a housing and a substrate stored in the housing. The housing comprises a button, a rod hole for guiding vertically a rod positioned under the button, taking the top of the button as an upper side, and the rod inserted in the rod hole. The substrate comprises an input element positioned under the rod. The rod is fitted with a covering member that covers the rod hole from above.

6 Claims, 13 Drawing Sheets

INPUT DEVICE FOR IN-VEHICLE DEVICE

INCORPORATION BY REFERENCE

This application claims priority based on a Japanese patent application, No. 2009-141399 filed on Jun. 12, 2009, the entire contents of which are incorporated herein by reference.

BACKGROUND OF THE INVENTION

The present invention relates to an input device for operating an in-vehicle device such as a navigation system, an air-conditioning system, or an audio system.

As an input device for an in-vehicle device, known is an input device comprising: an input sensing element for detecting a plurality of operations such as directing, turning and pushing-down; an operating knob connected to that input sensing element; input sensing elements each for detecting push-down operation; and push buttons connected to those input sensing elements (See Patent Document 1, for example).

Patent Document 1: Japanese Un-examined Patent Application Laid-Open No. 2006-331917

SUMMARY OF THE INVENTION

Sometimes such an input device for an in-vehicle device goes wrong when liquid (such as water or coffee spilled by a user of the input device) or dust permeates a gap (such as a gap between buttons or a gap between the operating knob and a button) existing in the operation surface in which the operating knob and the push buttons are arranged, since such liquid or dust may reach electronic parts such as an input sensing element or a circuit inside the housing. For example, if an input device is installed between two front seats in a vehicle in such a way that its operation surface faces the ceiling of the vehicle, liquid or dust easily falls upon the operation surface and thus there is a high probability that a failure occurs.

An object of the present invention is to provide a technique of preventing permeation of liquid and dust to electronic parts inside a housing of an input device for an in-vehicle device.

To solve the above-mentioned problem, one aspect of the present invention provides an input device for an in-vehicle device, wherein: the input device comprises a housing and a substrate stored in the housing; the housing comprises a button, a rod hole and a rod inserted in the rod hole, with the rod hole guiding vertically the rod positioned under the button taking a top of the button as an upper side; the substrate comprises an input element positioned under the rod; and the rod is fitted with a covering member that covers the rod hole from above.

Here, in the above-mentioned input device, a peripheral portion of the rod hole may be formed to be lower than a surface of a vicinity of the peripheral portion, so that the covering member is fitted into the peripheral portion. Further, in one of the above-mentioned input devices, it is possible that the peripheral portion of the rod hole has a groove along the rod hole in a top side that is in contact with the covering member; and the covering member is fixed by fitting a part of a bottom side of the covering member into the groove of the peripheral portion. Further, in one of the above-mentioned input devices, it is possible that the peripheral portion of the rod hole is formed such that a top side in contact with the covering member is flat; and the covering member is fixed by bonding a part of a bottom side of the covering member to a top side of the peripheral portion.

In one of the above-mentioned input devices, it is possible that the covering member is put on the rod in such a way that the covering member does not cover a top of the rod. In one of the above-mentioned input devices, it is possible that the rod has a groove in an upper part of the rod; and the covering member has a hole for inserting the rod, and is fixed by fitting an edge of the hole into the groove of the rod. Further, in one of the input devices, the covering member may be formed of an elastic material.

According to the present invention, in an input device for an in-vehicle device, it is possible to prevent permeation of liquid and dust to electronic parts within the housing more effectively. Thus, it is possible to reduce the probability of failure occurrence due to liquid or dust.

DETAILED DESCRIPTION

Figure 1:
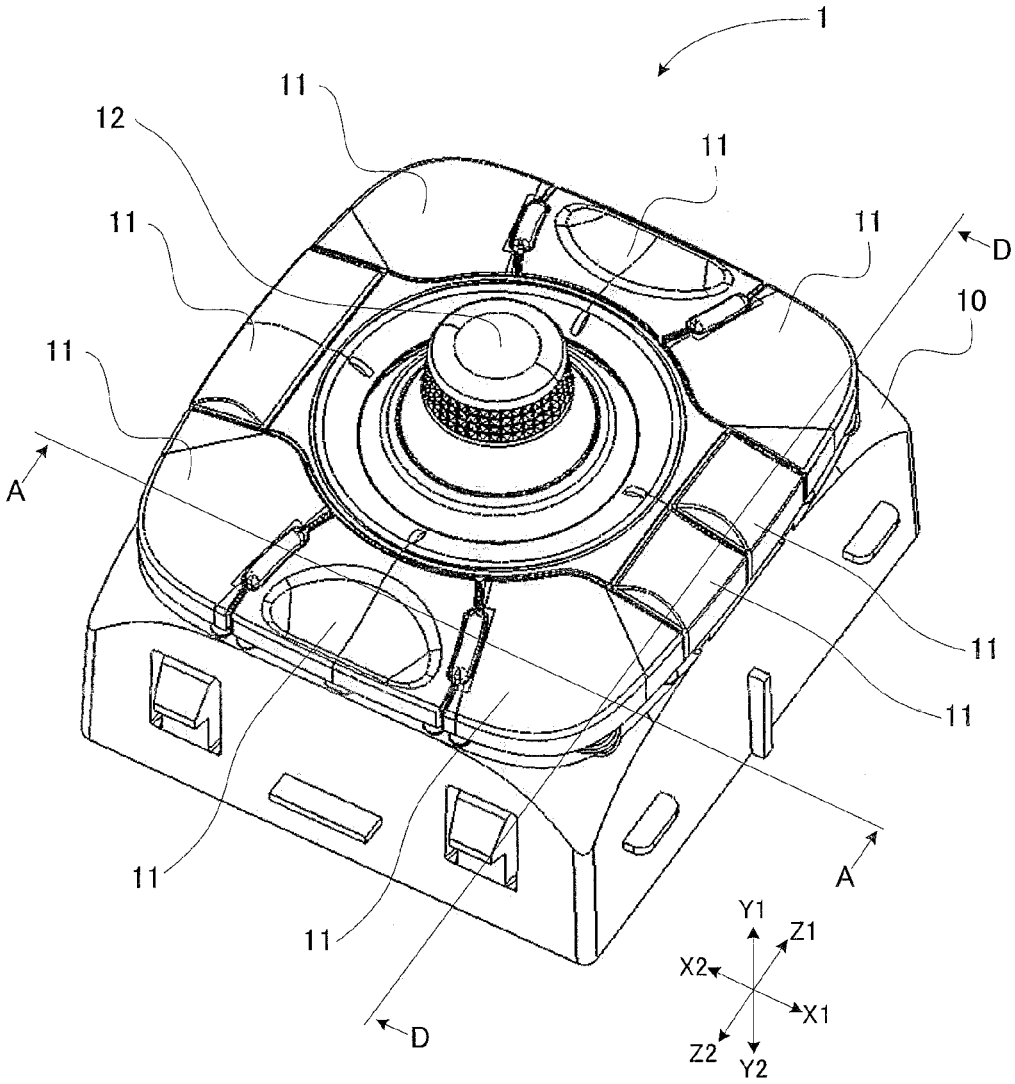
FIG. 1 is a perspective view showing an external appearance of an input device 1 according to one embodiment of the present invention.

An embodiment of the present invention will be described referring to the drawings. As an input device for an in-vehicle device, description of the present embodiment will take an example of an input device for a navigation system. Of course, an in-vehicle device is not limited to a navigation system, and may be an air conditioner or an audio system, for example.

Figure 2:
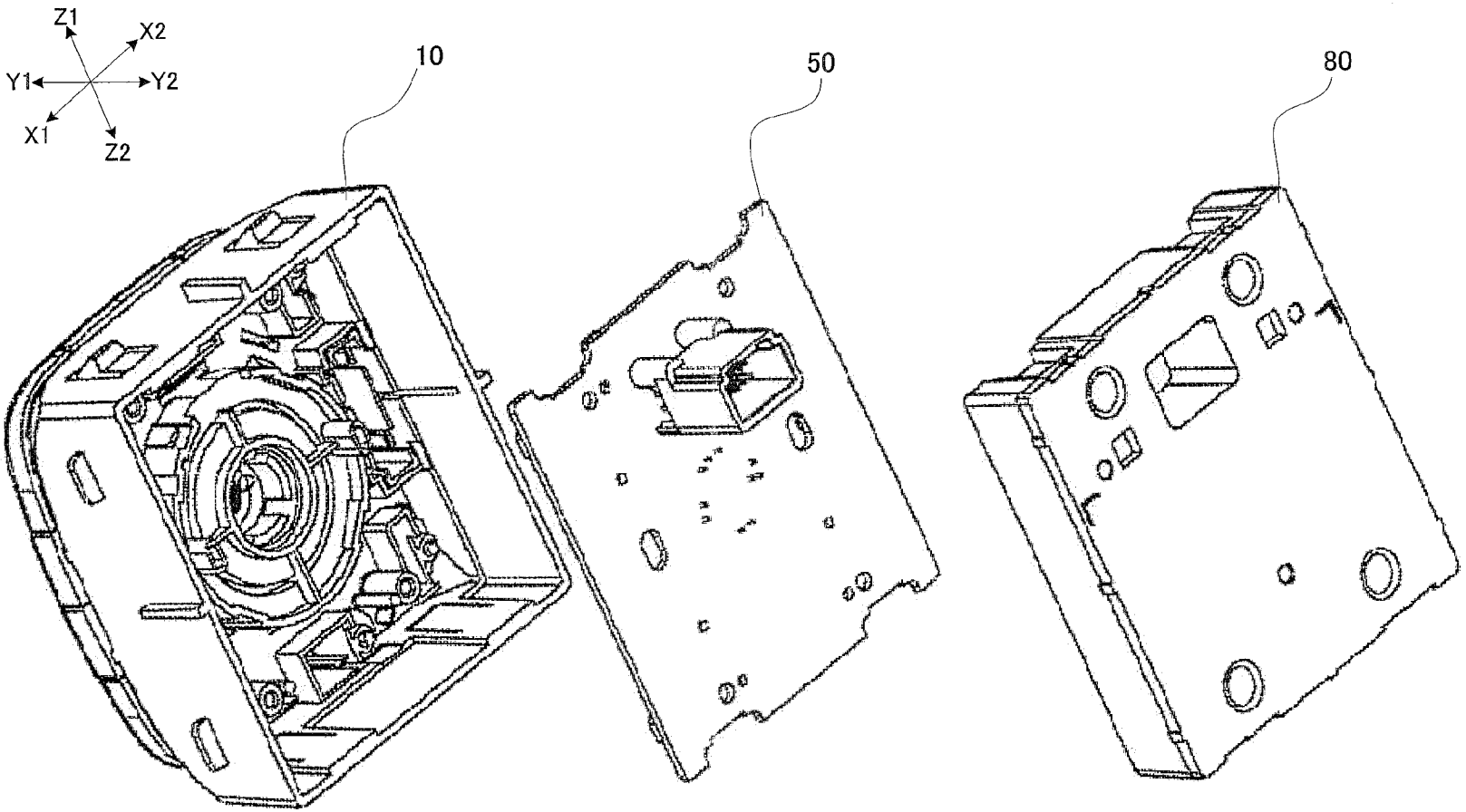
FIG. 2 is a perspective view showing a state in which the input device 1 has been disassembled into main parts.
Figure 3:
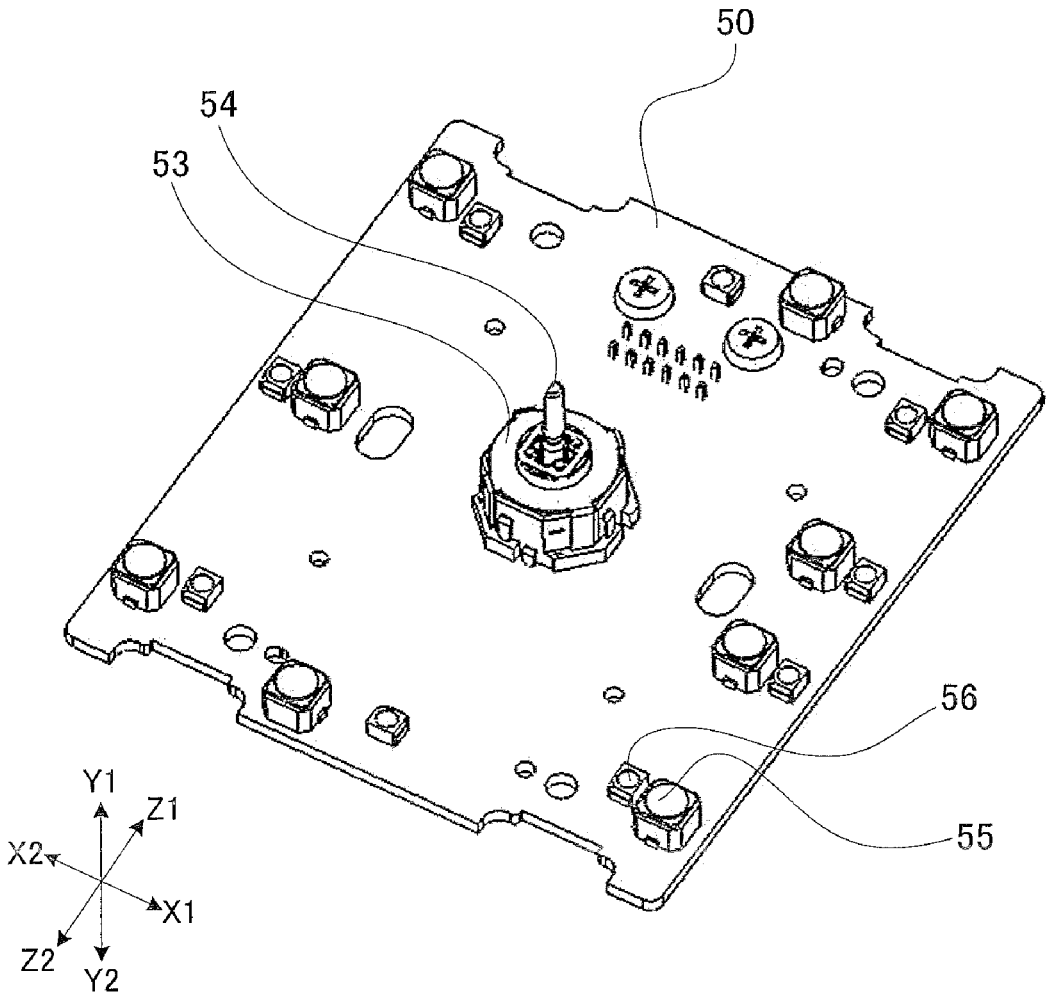
FIG. 3 is a perspective view showing an external appearance of a substrate 50 of the input device 1.
Figure 4:
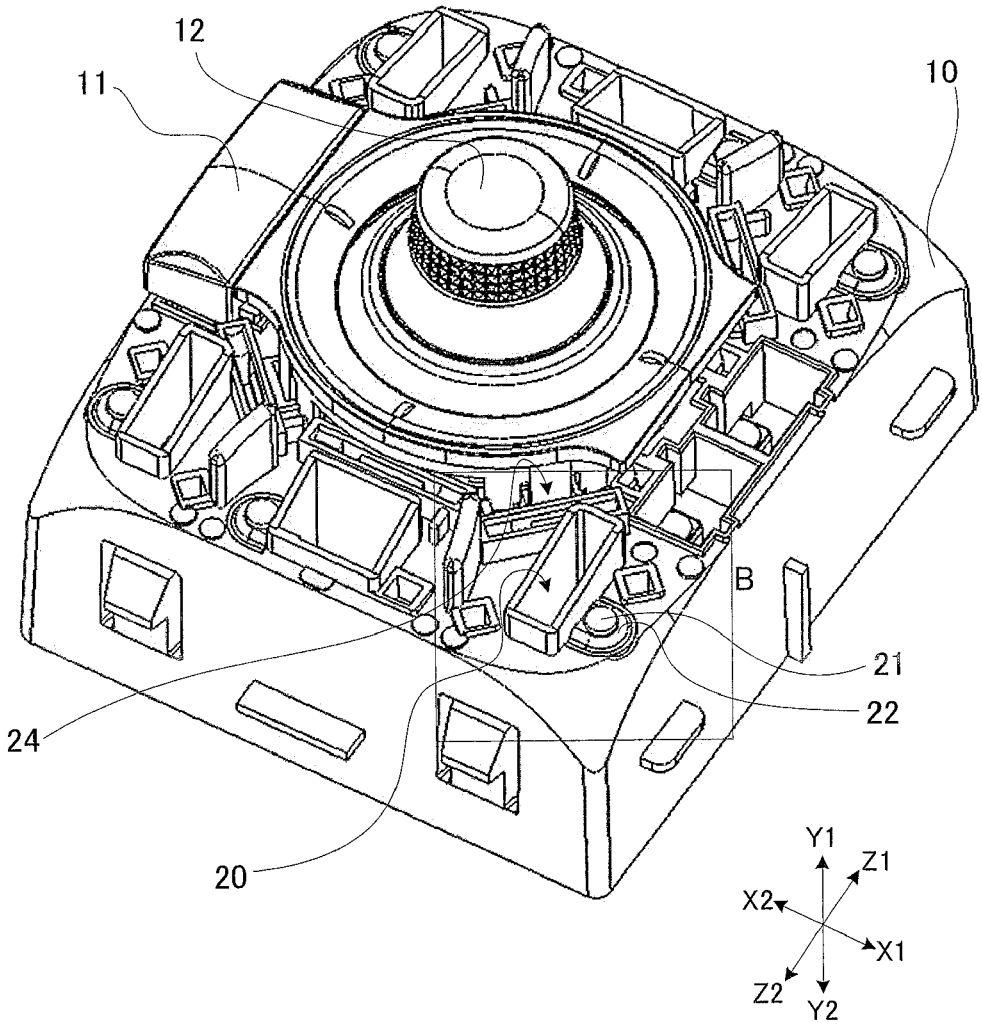
FIG. 4 is a perspective view showing an external appearance of the input device 1 (in a state that some buttons 11 have been removed)
Figure 5:
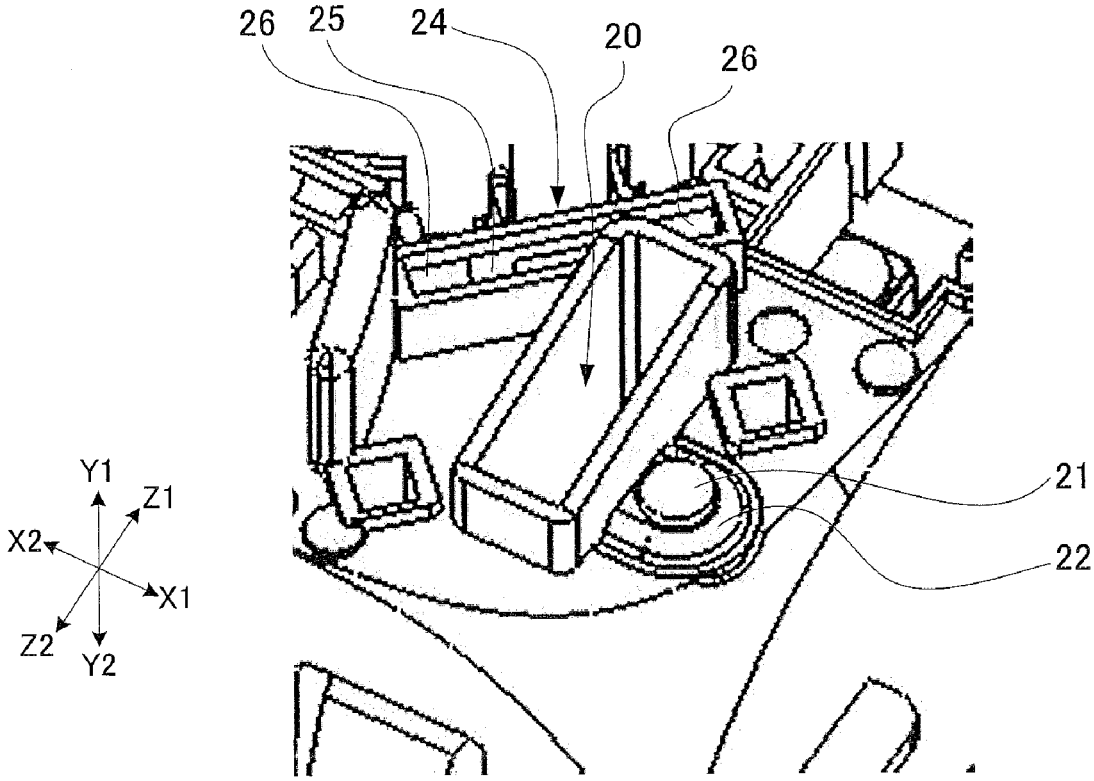
FIG. 5 is an enlarged perspective view showing a part (the area B in FIG. 4) of the external appearance of the input device 1.
Figure 6:
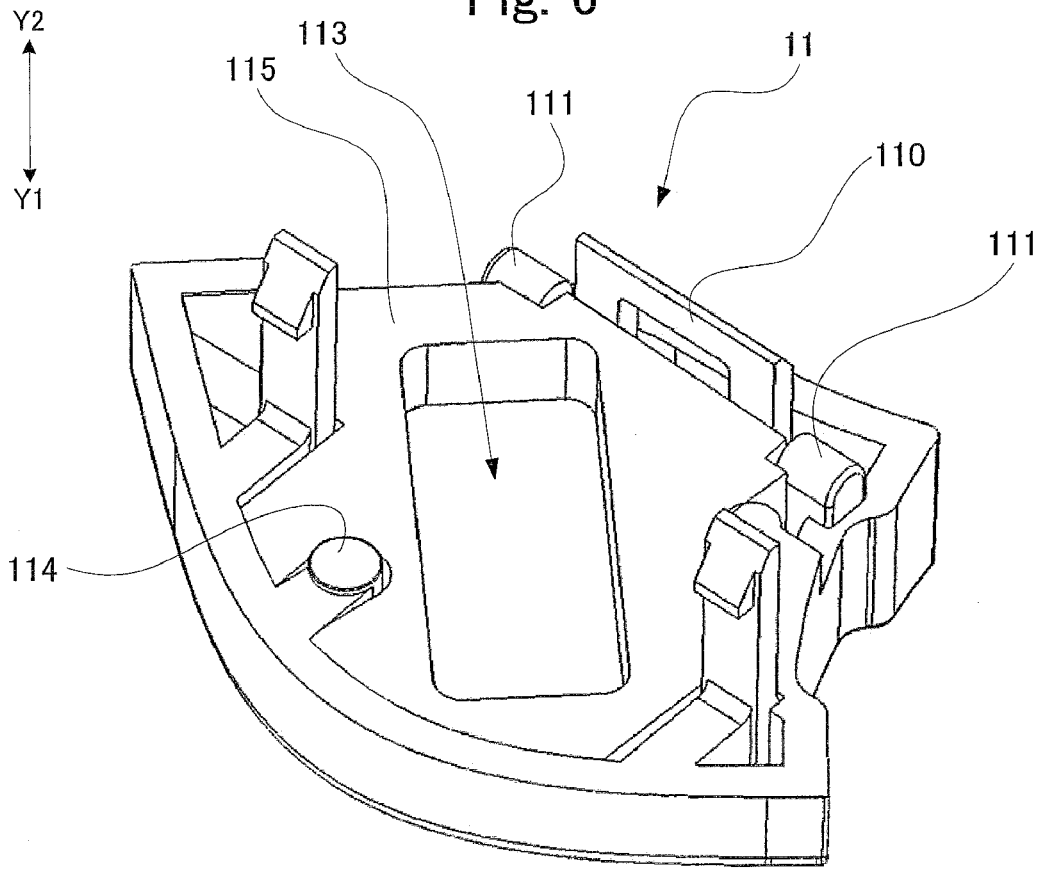
FIG. 6 is a perspective view showing an external appearance (of the reverse side) of a push button 11 of the input device 1.
Figure 7:
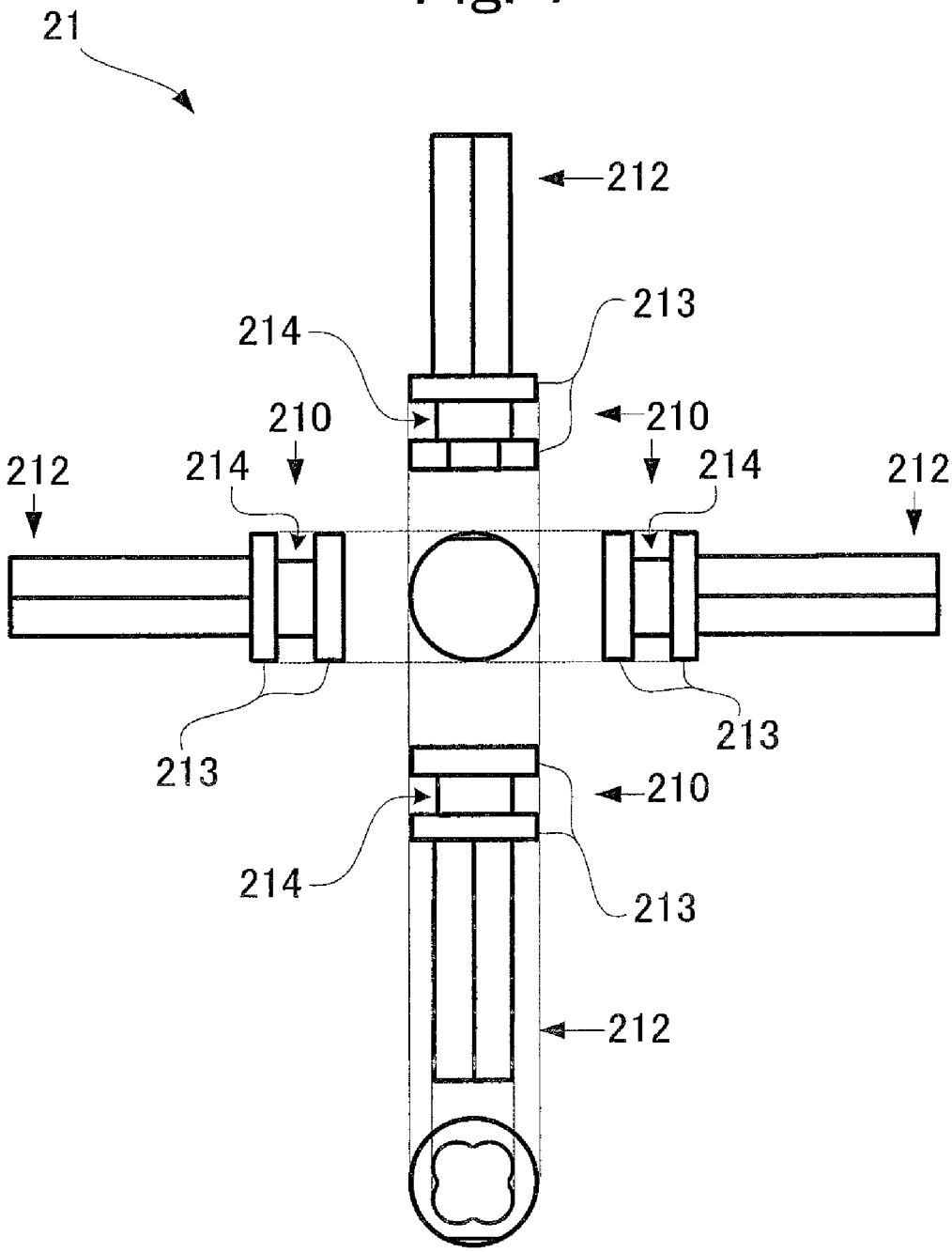
FIG. 7 is a view showing a rod 21 seen from a plurality of directions.
Figure 8:
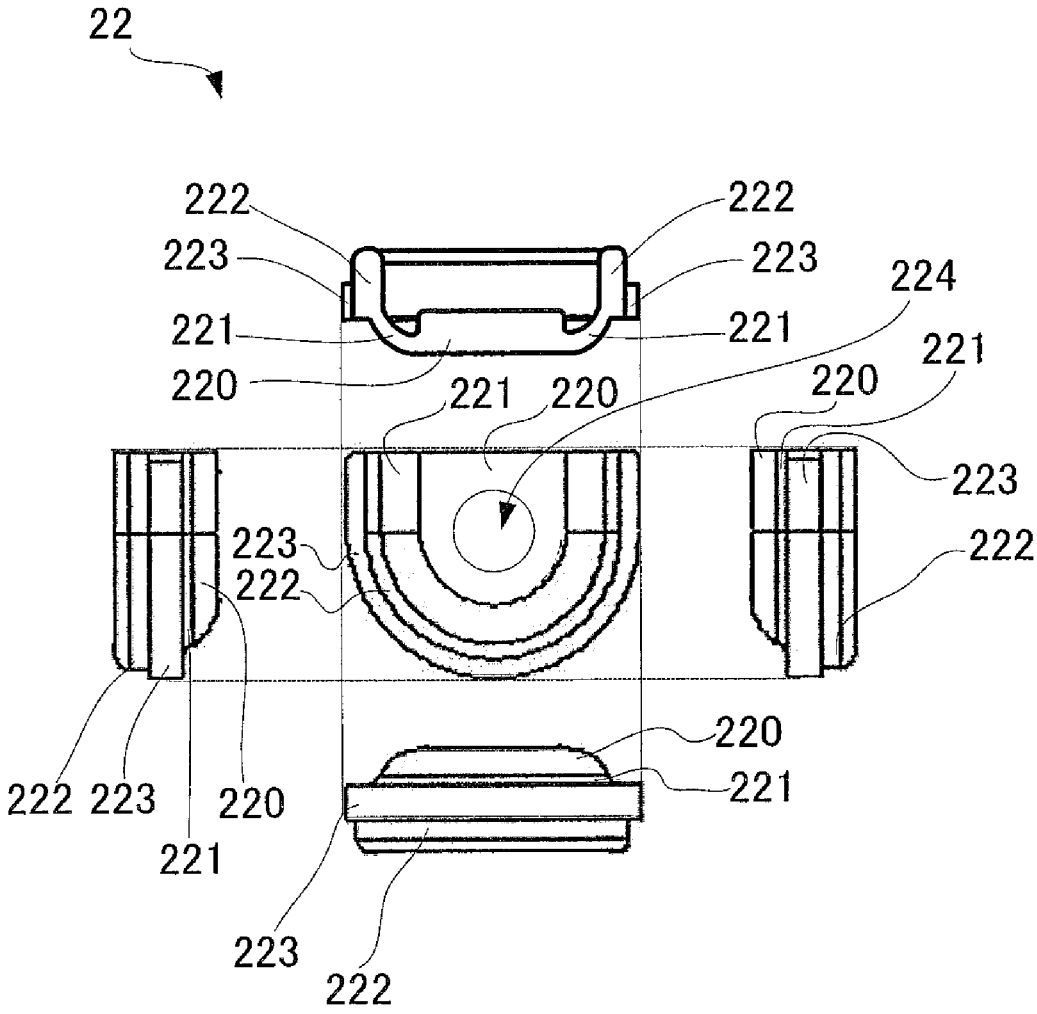
FIG. 8 is a view showing a covering member 22 seen from a plurality of directions.
Figure 9:
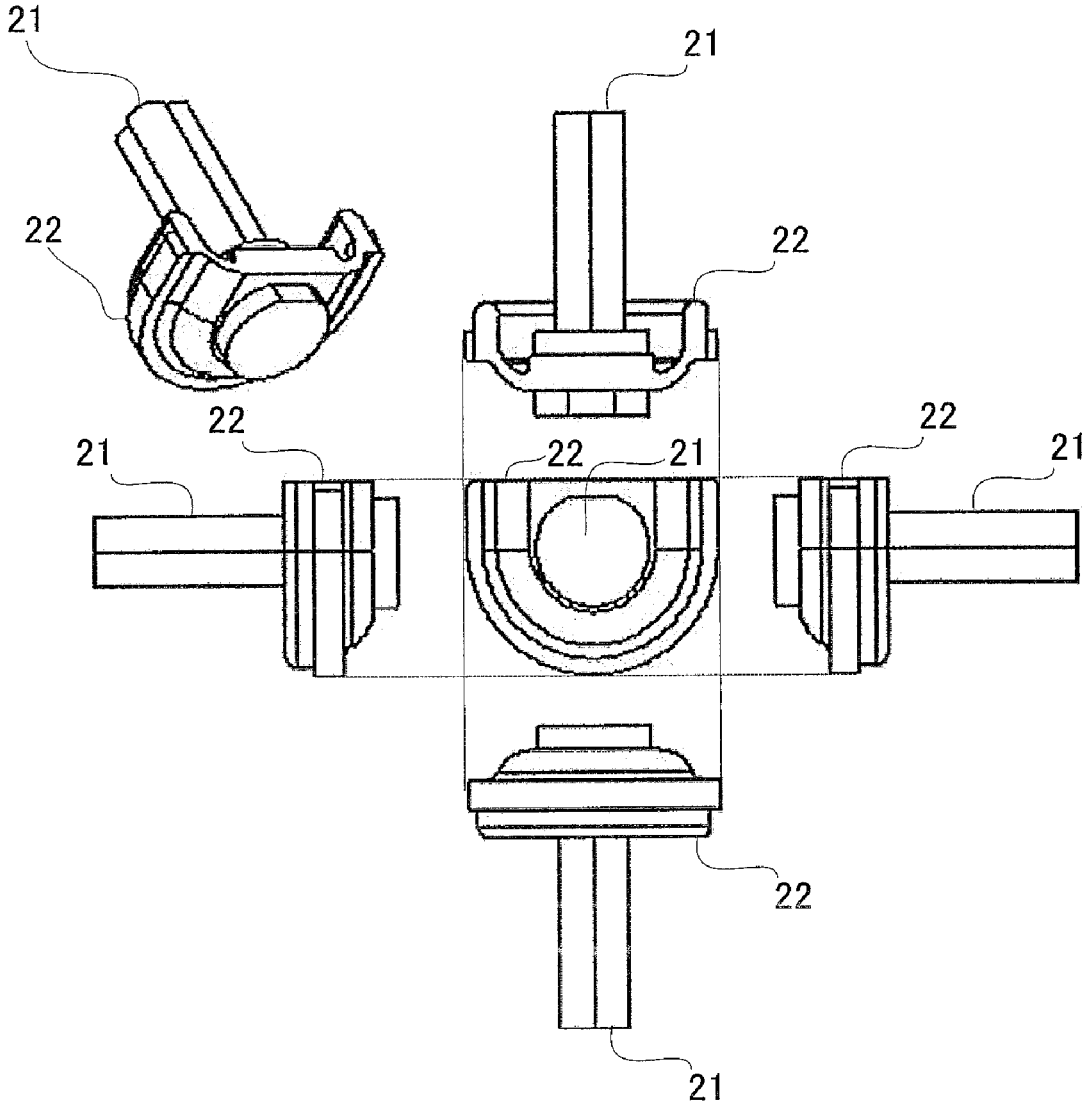
FIG. 9 is a view showing a rod 21 and a covering member 22 (in a combined state) seen from a plurality of directions.
Figure 10:
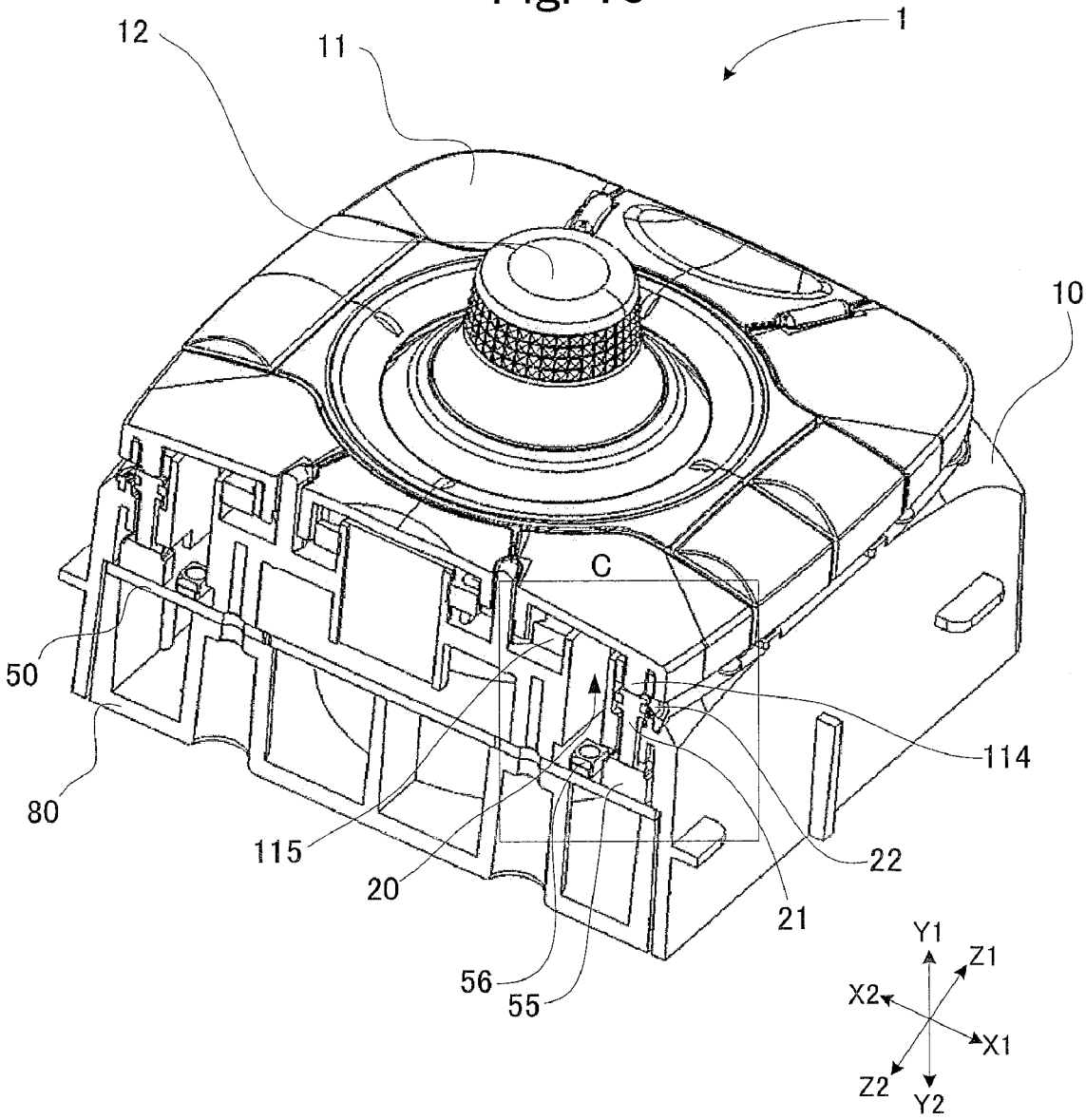
FIG. 10 is a perspective view showing a cross section (the cross section A in FIG. 1) of the input device 1.
Figure 11:
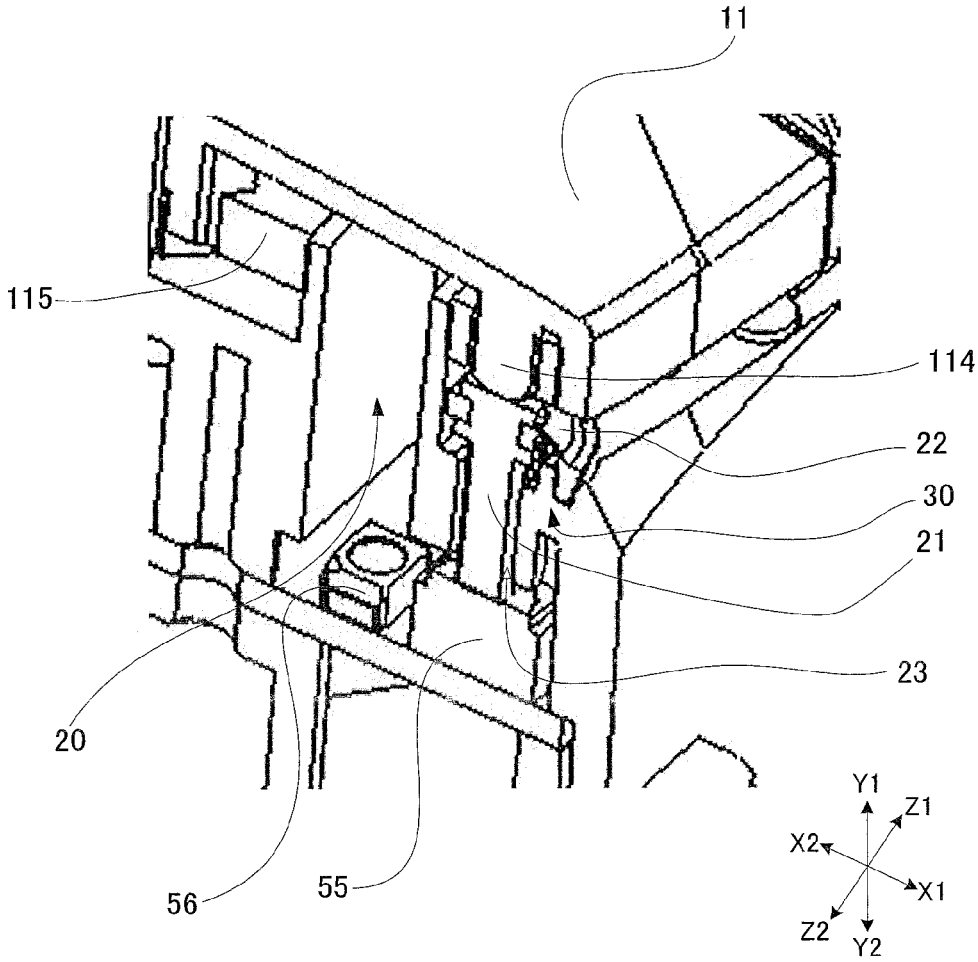
FIG. 11 is an enlarged perspective view showing a part (the area C in FIG. 10) of a cross section of the input device 1.
Figure 12:
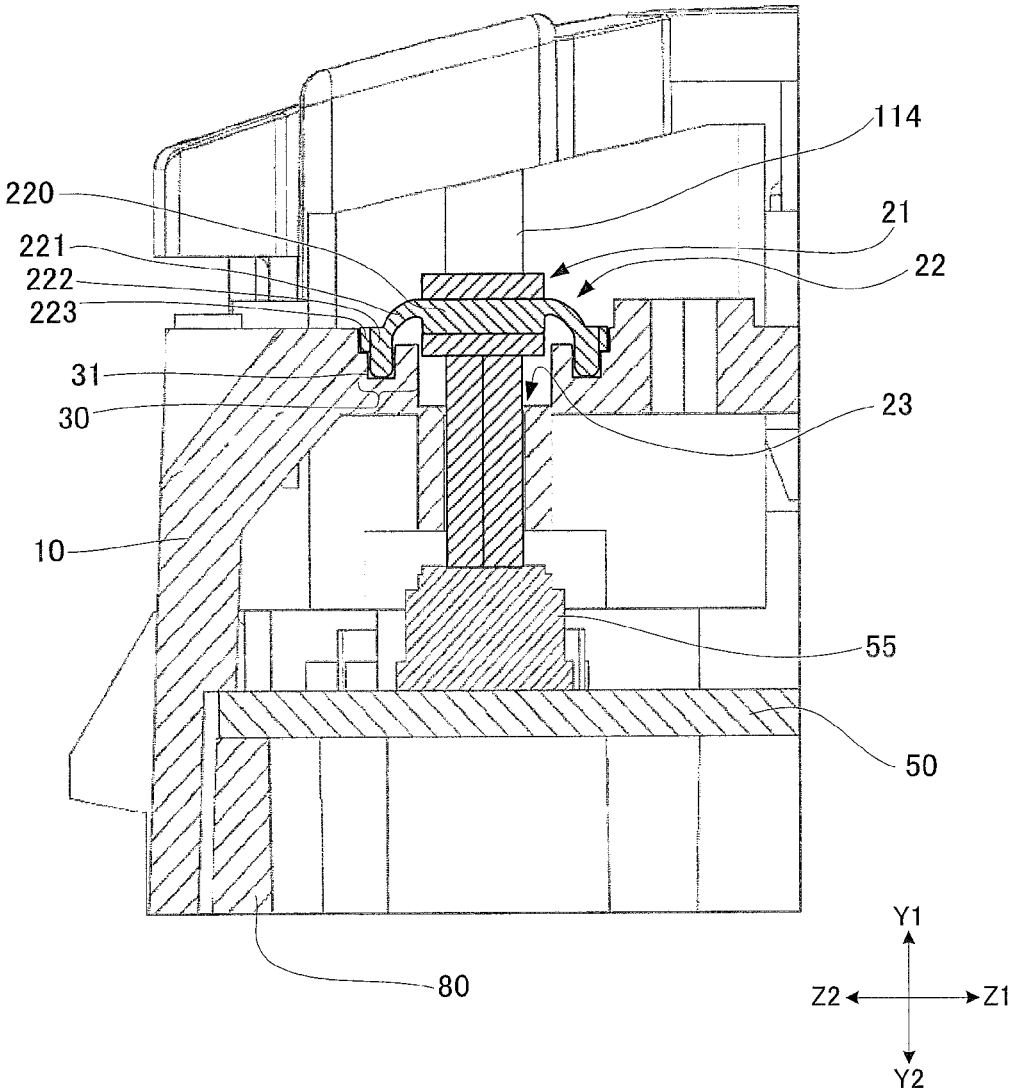
FIG. 12 is a cross-sectional view showing a part of a cross section (the cross section D in FIG. 1) of the input device 1.

FIG. 1 is a perspective view showing an external appearance of the input device 1 of the present embodiment of the invention. FIG. 2 is a perspective view showing a state in which the input device 1 has been disassembled into main parts. FIG. 3 is a perspective view showing an external appearance of a substrate 50 of the input device 1. FIG. 4 is a perspective view showing an external appearance of the input device 1 (in a state that some buttons 11 have been removed). FIG. 5 is an enlarged perspective view showing a part (the area B in FIG. 4) of the external appearance of the input device 1. FIG. 6 is a perspective view showing an external appearance (of the reverse side) of a push button 11 of the input device 1. FIG. 7 is a view showing a rod 21 seen from a plurality of directions. FIG. 8 is a view showing a covering member 22 seen from a plurality of directions. FIG. 9 is a view showing a rod 21 and a covering member 22 (in a combined state) seen from a plurality of directions. FIG. 10 is a perspective view showing a cross section (the cross section A in FIG. 1) of the input device 1. FIG. 11 is an enlarged perspective view showing a part (the area C in FIG. 10) of a cross section of the input device 1. And, FIG. 12 is a cross-sectional view showing a part of a cross section (the cross section D in FIG. 1) of the input device 1.

As shown in FIG. 1, the input device 1 comprises: a housing 10 having an operating portion (an operation surface) on its top side (the Y1 side); an operating knob 12 arranged in the center of the operating portion of the housing 10; and a plurality of push buttons 11 arranged around the operating knob 12. Further, as shown in FIG. 2, the substrate 50 (See FIG. 3) having input sensing elements and LEDs is set in the housing (front housing) 10. And the bottom side (the Y2 side) of the front housing 10 is closed by another housing (rear housing) 80.

As shown in FIG. 3, the substrate 50 has on its top side (the Y1 side): a multiple switch 53 as an input sensing element for detecting a plurality of operations such as directing, turning and pushing-down operations; a multiple switch rod 54 for connecting the multiple switch 53 and the operating knob 12; tact switches 55 and LEDs 56 arranged at respective positions corresponding to the push buttons 11.

The input device 1 of the present embodiment is connected to the main body of the navigation system through cable or the like. And, the input device 1 is installed for example between two front seats in a vehicle in a state that its operating portion (the Y1 side) faces the ceiling of the vehicle. As a result, liquid or dust easily falls upon the top surface (the Y1 side), and easily permeates a gap between push buttons 11 or a gap between the operating knob and the housing 10. Thus, as described below, the input device 1 has structure for preventing liquid and dust from reaching the substrate 50.

As shown in FIGS. 4 and 5, the housing 10 has light guide holes 20, rods 21, covering members 22, and slits 24.

Each light guide hole 20 guides light of an LED 56 on the substrate 50 (which is mounted on the bottom side (the Y2 side)) upwardly to a push button 11 (See FIGS. 10 and 11).

Each rod 21 is inserted down (in the Y2 direction) into a rod hole 23 (See FIGS. 10-12) formed in the top side of the housing 10. One end face (on the Y2 side) of the rod 21 is in contact with the top side of a tact switch 55 in the substrate 50. The other end face (on the Y1 side) of the rod 21 is in contact with a rod contact portion 114 (See FIG. 6) of the bottom side (the Y2 side) of a push button 11. In other words, the rod 21 is guided vertically by the rod hole 23. And, when the push button 11 is pushed down, the rod 21 is moved downward (Y2) to push down the tact switch 55.

Each covering member 22 is put on the upper portion (the Y1 side) of a rod 21. The covering member 22 has generally a shape of a reversed pan that has a flat bottom and is partly cut off in a vertical direction. The edge of the covering member 22 is fitted in a peripheral portion 30 of a rod hole 23 (See FIGS. 10-12) so as to cover the rod hole 23.

A plate portion 110 and an axis 111 (See FIG. 6) of a push button 11 are inserted into a slit 24. Inside each slit 24, a grappling portion 25 and bearings 26 are formed. The grappling portion 25 has a shape that grapples a hole of the inserted plate portion 110. The bearings 26 are in contact with the axis 111 of the push button 11. In other words, the push button 11 moves up and down pivoting the axis 111 that turns on the bearings 26.

As shown in FIG. 6, each push button 11 has on its bottom side (the Y2 side): the plate portion 110 for inserting into a slit 24; the axis 111 in contact with bearings 26 (See FIG. 4); and the rod contact portion 114 in contact with one end face (See FIG. 4) of a rod 21. Further, a light shield member 115 is fitted in the push button 11. A light guide hole 113 is formed in the light shield member 115 so as to guide light coming through a light guide hole 20 of the housing 10 to a partial area of the top side of the push button 11. The light shield member 115 is made of black sponge of synthetic resin, for example.

As shown in FIG. 7, in each rod 21, ribs 213 are formed as two disk plates on the side of a rod top 210 of the rod 21. A covering member 22 is mounted on the rod 21 by inserting a fixing portion 220 (See FIG. 8) of the covering member 22 in a groove 214 defined between the ribs 21. A rod bottom 212 of each rod has a shape of a cylinder having four slits.

As shown in FIG. 8, each covering member 22 has: the fixing portion 220 of a semi-circular disk that is to be inserted in the groove 214 (See FIG. 7) of a rod 21; a joining portion 221 of a semi-ring shape joining the fixing portion 220 to a supporting portion 222; the supporting portion 222 of a semi-ring shape, which is to be fitted in a groove 31 (See FIGS. 10-12) formed in the peripheral portion 30 of a rod hole 23 in the housing 10; and an extended portion 223 formed on the circumference of the supporting portion 222 that is to be fitted in the peripheral portion 30 of the rod hole 23. In the fixing portion 220, is formed a rod hole 224 into which a rod 21 is inserted.

As shown in FIG. 9, a covering member 22 is fitted on a rod 21 by inserting the rod 21 into the rod hole 224 of the covering member 22 so that the fixing portion 220 is inserted in the groove 214 of the rod 21.

Each covering member 22 is integrally formed of elastic material such as synthetic resin or rubber so that a rod 21 can move up and down. When the rod 21 moves up and down, particularly the joining portion 221 of the covering member 22 bends. Thus, the joining portion 221 is formed to be thinner than the fixing portion 220 and the supporting portion 222.

As shown in FIGS. 10-12, the peripheral portion 30 of a circular rod hole 23 is formed to have a semi-ring shape so that the supporting portion 222 and the extended portion 223 of a covering member 22 can be fitted in. In other words, the peripheral portion 30 is formed to be lower than the top side (the Y1 side) of the housing 10 on the outside of the peripheral portion 30.

Further, the peripheral portion 30 is formed to follow the shapes of the supporting portion 222 and the extended portion 223 of a covering member 22. In other words, the peripheral portion 30 is formed to follow the bottom and perpendicular wall surface of the peripheral portion 30 so that sides of the extended portion 223 of a covering member 22 come to be in tight contact with the bottom and perpendicular wall surface of the peripheral portion 30. Further, the groove 31 of a ring shape is formed in the bottom of the peripheral portion 30 such that the lower portion of the supporting portion 222 can be fitted in the groove 31.

In the present embodiment, the rod holes 23 are formed closely to the respective light guide holes 20. Thus, seen from above (from the Y1 side), each of the covering members 22 and the peripheral portions 30 has a shape that is partly cut off in a straight line along the light guide hole 20 related. However, depending on the positions of the rod holes 23, shapes of the covering members 22 and the peripheral portions 30 may be suitably changed. For example, seen from above, each may have a circular or oval shape.

Hereinabove, one embodiment of the present invention has been described. According to this embodiment, in an input device for an in-vehicle device, it is possible to prevent permeation of liquid and dust to electronic parts within the housing more effectively. And thus, it is possible to reduce possibility of failures due to liquid or dust.

That is to say, in this embodiment, each rod hole for inserting a rod for pushing down a switch is covered by a covering member. As a result, liquid and dust can hardly permeate gaps between a rod hole and a rod. Further, the peripheral portion of each rod hole is formed to have a shape in which a covering member is fitted. By this arrangement also, liquid and dust can hardly permeate.

Further, the groove is formed in the peripheral portion of each rod hole such that a part of the edge of the covering member is fitted in the groove. By this arrangement, liquid and dust can more hardly permeate. Further, the extended portion is formed in each covering member so that the covering member covers the outside of the groove of the peripheral portion. By this arrangement, liquid and dust can much more hardly permeate.

Further, each rod and each covering member are formed and mounted such that the end face of each rod at which the rod is in contact with a push button is not covered by the covering member. By this arrangement, the feelings of click and stroke at pushing of a push button are not spoiled.

Next, another embodiment of the present invention will be described referring to a drawing. The present embodiment differs from the input device 1 of the above-described embodiment in shapes of the covering member 22 and the peripheral portion 30 of each rod hole 23. In the following, different points will be mainly described.

Figure 13:
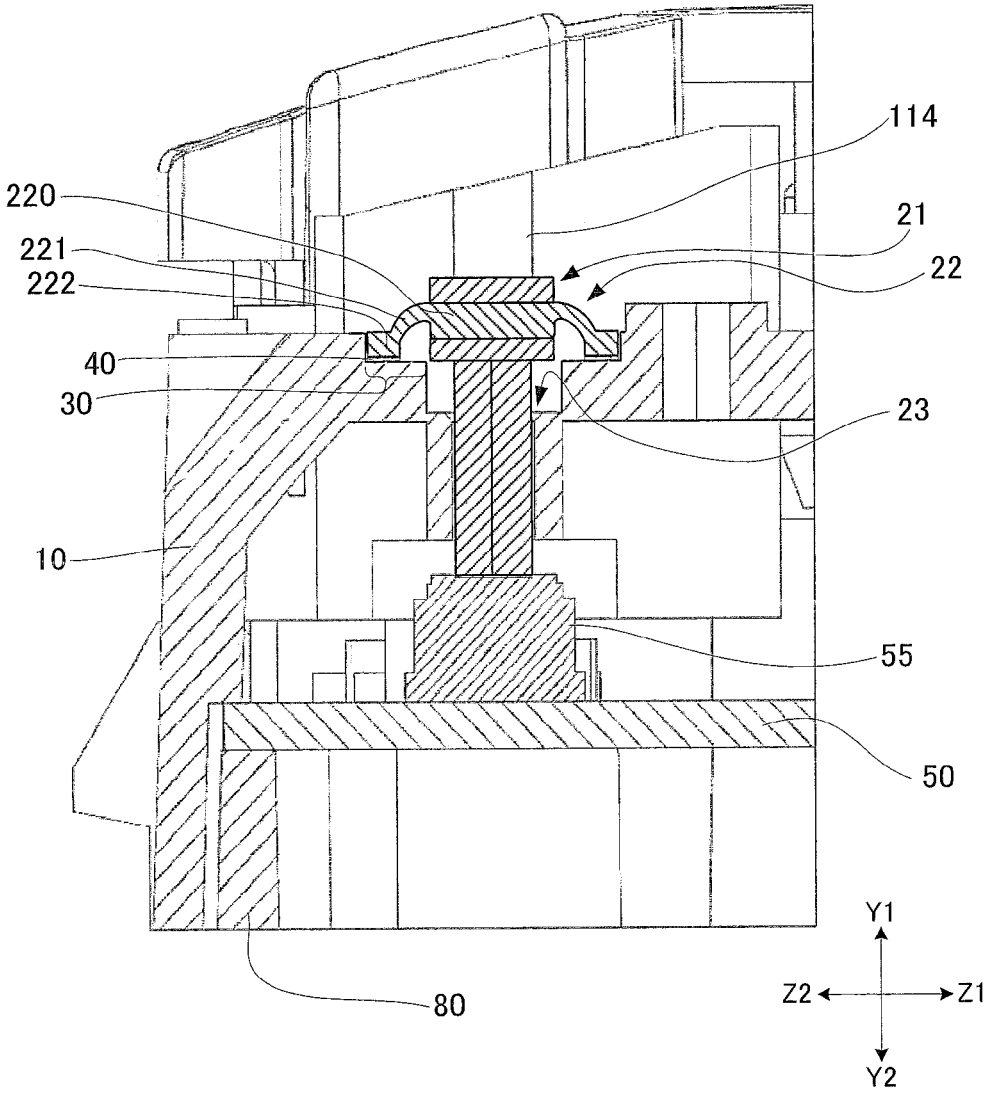
FIG. 13 is a cross-sectional view showing a part of a cross section (corresponding to the cross section D in FIG. 1) of an input device 1 according to another embodiment of the present invention.

FIG. 13 is a cross-sectional view showing a part of cross section (corresponding to the cross section D in FIG. 1) of the input device 1 of the present embodiment of the present invention.

As shown in FIG. 13, each covering member 22 has: a fixing portion 220 of a semi-disk shape to be inserted in a groove 214 (See FIG. 7) of a rod 21; a joining portion 221 of a semi-ring shape joining the fixing portion 220 to a supporting portion 222; and the supporting portion 222 of a semi-ring shape to be fitted in a peripheral portion 30 of a rod hole 23 in a housing 10. The bottom side (the Y2 side) of the supporting portion 222 is formed to be flat and to follow the bottom (the Y1 side) of the peripheral portion 30.

Each peripheral portion 30 is formed to follow the shape of the supporting portion 222 of a covering member 22. In other words, the peripheral portion 30 is formed such that sides of the supporting portion 222 come to be in tight contact with the bottom and perpendicular wall surface of the peripheral portion 30. Further, the bottom of the peripheral portion 30 is formed to be flat and to follow the bottom side of the supporting portion 222.

Here, each covering member 22 is fixed by bonding the bottom side (the Y2 side) of the supporting portion 222 to the bottom (the Y1 side) of a peripheral portion 30 by means of double-faced adhesive tape 40. Of course, the fixing method is not limited to use of double-face adhesive tape, and for example a gel adhesive may be used.

Hereinabove, another embodiment of the present invention has been described. According to this embodiment, the covering member is bonded to the peripheral portion of a rod hole. As a result, liquid and dust can more hardly permeate.

The above-described embodiments of the present invention are intended to illustrate and not to limit the gist and scope of the present invention. Many alternatives, modifications and variations of the present invention are apparent to persons skilled in the art.

1: input device; 10: housing; 11: push button; 12: operating knob; 20: light guide hole; 21: rod; 22: covering member; 23: rod hole; 24: slit; 25: grappling portion; 26: bearing; 30: peripheral portion; 31: groove; 40: double-faced adhesive tape; 50: substrate; 53: multiple switch; 54: multiple switch rod; 55: tact switch; 56: LED; 80: housing; 110: plate portion; 111: axis; 113: light guide hole; 114: rod contact portion; 115: light shield member; 210: rod top; 212: rod bottom; 213: rib; 214: groove; 220: fixing portion; 221: joining portion; 222: supporting portion; 223: extended portion; and 224: rod hole.

The invention claimed is:

1. An input device for an in-vehicle device, the input device including:

a rod;

a rod contact portion arranged above and in contact with the rod;

a housing for storing an input element provided on a substrate, the housing including:

a top surface;

a rod hole surface arranged below the top surface, the rod hole surface defining a rod hole in which the rod is inserted, the rod hole surface being configured to substantially vertically guide the rod that is pushed by the rod contact portion to operatively contact the input element, and a transitional surface between the top surface and the rod hole surface, the transitional surface including a step structure formed by a bottom side and a vertical side substantially orthogonal to the bottom side; and a covering member fitted with the rod, the covering member having an edge formed to follow the shape of the step structure of the transitional surface so that the covering member covers the rod hole.

2. The input device according to claim 1, wherein:

the transitional surface defines a downward extending groove along the longitudinal direction of the rod hole, the downward extending groove including the bottom side and the vertical side substantially orthogonal to the bottom side, and the covering member is fixed to the housing by fitting the edge of the covering member into the downward extending groove of the transitional surface of the housing.

3. The input device according to claim 1, wherein:

the covering member is fixed to the housing by bonding the edge of the covering member to the step structure of the transitional surface of the housing.

4. The input device according to claim 1, wherein:

the covering member is fitted with the rod in such a way that the covering member does not cover a top of the rod.

5. The input device according to claim 1, wherein:

the rod has a groove in an upper part of the rod; and the covering member has a hole for inserting the rod, and is fixed by fitting an edge of the hole into the groove of the rod.

6. The input device according to claim 1, wherein:

the covering member is formed of an elastic material.

* * * * *